US008164242B2

(12) United States Patent
Yoshimoto et al.

(10) Patent No.: US 8,164,242 B2
(45) Date of Patent: Apr. 24, 2012

(54) SPARK PLUG

(75) Inventors: Osamu Yoshimoto, Inazawa (JP); Kenji Nunome, Nagoya (JP); Yoshihiro Nakai, Osaka (JP); Taichiro Nishikawa, Osaka (JP); Toru Tanji, Osaka (JP); Kazuo Yamazaki, Osaka (JP)

(73) Assignees: NGK Spark Plug Co., Ltd., Aichi (JP); Sumitomo Electric Industries, Ltd., Osaka (JP)

( * ) Notice: Subject to any disclaimer, the term of this patent is extended or adjusted under 35 U.S.C. 154(b) by 37 days.

(21) Appl. No.: 12/167,387

(22) Filed: Jul. 3, 2008

(65) Prior Publication Data

US 2009/0009048 A1 Jan. 8, 2009

(30) Foreign Application Priority Data

Jul. 6, 2007 (JP) ..... 2007-179066

(51) Int. Cl.
*H01T 13/39* (2006.01)
*H01T 13/00* (2006.01)

(52) U.S. Cl. ..... 313/141; 313/118

(58) Field of Classification Search ..... 313/141
See application file for complete search history.

(56) References Cited

U.S. PATENT DOCUMENTS

| | | | | |
|---|---|---|---|---|
| 6,094,000 | A | 7/2000 | Osamura et al. | |
| 2004/0013560 | A1 * | 1/2004 | Hrastnik | 420/455 |

FOREIGN PATENT DOCUMENTS

| | | | | |
|---|---|---|---|---|
| JP | 58-165288 | A | | 9/1983 |
| JP | 61-7536 | A | | 1/1986 |
| JP | 06024091 | B | * | 3/1994 |
| JP | 6-338376 | A | | 12/1994 |
| JP | 06338376 | A | * | 12/1994 |
| JP | 9-007733 | A | | 1/1997 |
| JP | 9291327 | A | | 11/1997 |
| JP | 2001-257053 | A | | 9/2001 |
| JP | 2001-335360 | A | | 12/2001 |
| JP | 2001-355031 | A | | 12/2001 |
| JP | 2004-206931 | A | | 7/2004 |
| JP | 2004206931 | A | * | 7/2004 |
| JP | 2004-247175 | A | | 9/2004 |
| JP | 2005-15826 | A | | 1/2005 |
| JP | 2005015826 | A | * | 1/2005 |
| JP | 2006-316343 | A | | 11/2006 |
| JP | 2006-316344 | A | | 11/2006 |
| JP | 2007-173197 | A | | 7/2007 |
| KR | 97-004196 | A | | 1/1997 |

OTHER PUBLICATIONS

Japanese Office Action dated May 19, 2009.
Korean Office Action issued in counterpart Application No. 10-2008-0065018, dated Aug. 25, 2010.
Chinese Office Action issued on Mar. 1, 2011 in the corresponding Chinese Patent Application No. 200810130603.8.

* cited by examiner

*Primary Examiner* — Joseph L Williams
*Assistant Examiner* — Nathaniel Lee
(74) *Attorney, Agent, or Firm* — Sughrue Mion, PLLC

(57) ABSTRACT

A spark plug (100) includes: a center electrode (2); and a ground electrode (30) which is to be exposed in a combustion chamber of an internal combustion engine and which forms a spark discharge gap with the center electrode (2), wherein at least one of the center electrode (20) and the ground electrode (30) contains an electrode material whose principal component is Ni and in which an intermetallic compound is precipitated at least intergranularly and intragranularly.

21 Claims, 5 Drawing Sheets

SPARK PLUG

CROSS-REFERENCE TO RELATED APPLICATIONS

This application claims the benefit of Japanese Patent Application JP 2007-179066, filed Jul. 6, 2007, the entire content of which is hereby incorporated by reference, the same as if set forth at length.

FIELD OF THE INVENTION

The present invention relates to a spark plug for an internal combustion engine using an Ni-based alloy as the material of electrodes for effecting spark discharge.

BACKGROUND OF THE INVENTION

Conventionally, a spark plug for ignition is used in an internal combustion engine such as an automobile engine. A spark plug in general has a structure in which an insulator with a center electrode insertedly provided therein is held by a metal shell in such a manner as to surround the periphery of the insulator, and a spark discharge gap is formed between the center electrode and a ground electrode joined to a leading end of the metal shell. The ignition of an air-fuel mixture flowing in between the both electrodes is effected by a spark discharge which is generated between the center electrode and the ground electrode.

When such a spark plug is used, a load accompanying the spark discharge, which is repeatedly effected in a combustion chamber which is set to high temperature in the neighborhood of 10,000° C., is applied to the electrodes, so that compatibility of spark wear resistance and high-temperature oxidation resistance is required for the electrode material used for the electrode. When the electrode material is affected by the load due to the high temperature and the spark discharge, crystal grains constituting the electrode material coarsen (undergo so-called grain growth), and the structure of their grain boundaries becomes simplified. Then, the ingress of oxygen into the interior of the electrode material becomes facilitated just as if the simplified intergranular structure forms guide passageways for oxygen, with the result that oxidative corrosion possibly becomes likely to occur in the interior.

Accordingly, to suppress the grain growth, an electrode material is known in which a metal element such as Y or Zr is added to Ni (e.g., refer to JP-A-2004-247175). In JP-A-2004-247175, an electrode material is formed in which a powder consisting of such as oxides or nitrides of these elements is mixed with an Ni powder, which mixture is quench-hardened after molding, allowing such as oxides or nitrides of the aforementioned elements to precipitate in the parent phase of Ni in a uniformly distributed state. In the electrode fabricated from such an electrode material, even if the electrode is affected by the load due to high temperature and spark discharge, such as oxides or nitrides precipitated in the parent phase of Ni suppresses in a pinning manner the coarsening of their crystal grains in the course of coarsening of the crystal grains, so that it is possible to suppress the grain growth. As the grain growth is suppressed, the grain size of the crystal grains is maintained in a small state. Since the structure of the grain boundaries is maintained in a relatively complex state because of it, the ingress of oxygen into the interior of the electrode along the grain boundaries is suppressed, so that the high-temperature oxidation resistance improves.

On the other hand, if the amount of the aforementioned elements added increases, it leads to an increase in the specific resistance of the electrode material and a decline in thermal conductivity, with the result that the spark wear resistance declines. In JP-A-2004-247175, by increasing the purity of Ni in the electrode material, the specific resistance of the electrode material is lowered and the thermal conductivity is improved, thereby enhancing the spark wear resistance.

SUMMARY OF THE INVENTION

However, in conjunction with the trend toward higher performance of engines in recent years, the combustion of the air-fuel mixture tends to be effected at higher temperatures, so that the electrode material of electrodes is required to meet the high-temperature oxidation resistance and the spark wear resistance at a higher level. In the case where oxides are precipitated in the parent phase of Ni of the electrode material, the precipitated oxides remain in the electrode material, and the oxides disadvantageously decompose in an environment which is set to higher temperatures than in conventional cases, possibly causing internal corrosion to progress due to oxygen.

The present invention has been devised to overcome the above-described problems, and its object is to provide a spark plug which is capable of obtaining sufficient high-temperature oxidation resistance and spark wear resistance by using as the electrode an electrode material in which intermetallic compounds are precipitated in the parent phase of Ni.

To attain the above object, in accordance with a first aspect of the invention there is provided a spark plug comprising: a center electrode; and a ground electrode which is to be exposed in a combustion chamber of an internal combustion engine and which forms a spark discharge gap with the center electrode, wherein at least one of the center electrode and the ground electrode is formed of an electrode material whose principal component is Ni and in which an intermetallic compound is precipitated at least intergranularly and intragranularly.

The spark plug according to a second aspect is characterized in that, in addition to the configuration of the invention according to the first aspect, the intermetallic compound is a compound including at least Ni and a rare earth metal.

The spark plug according to a third aspect is characterized in that, in addition to the configuration of the invention according to the first or second aspect, the intermetallic compound is one of a compound including at least Ni and Y and a compound including Ni and Nd.

The spark plug according to a fourth aspect is characterized in that, in addition to the configuration of the invention according to the third aspect, the intermetallic compound contains Ni as a principal component and contains as a first additional element an element of one of Y and Nd, a content of the first additional element being not less than 0.3 wt. % and not more than 3 wt. %.

The spark plug according to a fifth aspect is characterized in that, in addition to the configuration of the invention according to the fourth aspect, the intermetallic compound contains as a second additional element at least one element selected from the group consisting of Si, Ti, Ca, Sc, Sr, Ba, and Mg.

The spark plug according to a sixth aspect is characterized in that, in addition to the configuration of the invention according to the fifth aspect, a content of the second additional element in the electrode material is less than 1 wt. %.

The spark plug according to a seventh aspect is characterized in that, in addition to the configuration of the invention according to the sixth aspect, the second additional element of the electrode material is Si, and a content thereof is less than 0.3 wt. %.

The spark plug according to an eighth aspect is characterized in that, in addition to the configuration of the invention according to any one of the fifth to seventh aspects, in the electrode material the content of the first additional element is greater than the content of the second additional element.

The spark plug according to a ninth aspect is characterized in that, in addition to the configuration of the invention according to the eighth aspect, in the electrode material the content of the first additional element is not less than 3 times the content of the second additional element.

The spark plug according to a 10th aspect is characterized in that, in addition to the configuration of the invention according to any one of the fifth to ninth aspects, the electrode material is formed by using a raw material in which Ni, the first additional element, and the second additional element are mixed by melting.

The spark plug according to an 11th aspect is characterized in that, in addition to the configuration of the invention according to any one of the first to 10th aspects, an amount of oxygen dissolved in the electrode material is not more than 30 ppm.

The spark plug according to a 12th aspect is characterized in that, in addition to the configuration of the invention according to any one of the first to 11th aspects, in the electrode material an average grain size of crystal grains after being held for 72 hours at 1000° C. is not more than 300 μm.

The spark plug according to a 13th aspect is characterized in that, in addition to the configuration of the invention according to any one of the first to 12th aspects, the electrode material has a specific resistance at normal temperature of not more than 15 μΩcm.

The spark plug according to a 14th aspect is characterized in that, in addition to the configuration of the invention according to any one of the first to 13th aspects, a ratio ($\sigma 0.2/\sigma B$) of 0.2% proof stress ($\sigma 0.2$) to tensile strength ($\sigma B$) is not less than 0.4 and not more than 0.6.

The spark plug according to a 15th aspect is characterized in that, in addition to the configuration of the invention according to any one of the first to 14th aspects, the electrode material is a material constituting the ground electrode (30).

In the spark plug according to the first aspect of the invention, since an electrode material, whose principal component is Ni and in which an intermetallic compound is precipitated at least intergranularly, is used for the center electrode or the ground electrode, oxygen is not included in the compound, so that internal corrosion is unlikely to occur even if the electrode material is used in a high-temperature environment. Although there are cases where crystal grains constituting the electrode material coarsen (i.e., undergo grain growth) due to secondary recrystallization in a harsh environment in which a load accompanying the spark discharge which is effected at high temperature is applied, the grain growth is suppressed by the intermetallic compound precipitated at least in the grain boundary. If the grain growth can be suppressed, the intergranular structure can be maintained in a complex state as it is. Therefore, even if oxygen enters from the outside along the grain boundaries, the ingress depth does not become deep, so that it is possible to obtain a sufficient effect with respect to the suppression of oxidation. If the intermetallic compound is precipitated at least in the grain boundary of the electrode base material, it is possible to obtain a sufficient effect in suppressing the coarsening of the crystal grains. However, the intermetallic compound may precipitate not only intergranularly but intragranularly, and the site of its precipitation is not limited. It should be noted that the term "principal component" referred to herein means a component whose content is the largest among the components constituting the electrode material.

Such an intermetallic compound is preferably formed by a compound including at least Ni and a rare earth metal as in the second aspect of the invention, or if the intermetallic compound is one of a compound including at least Ni and Y and a compound including Ni and Nd, it is easy to form a stable intermetallic compound, which is therefore more preferable.

To obtain an electrode material in which the intermetallic compound is precipitated, the intermetallic compound should preferably contain Ni as a principal component and contains as a first additional element an element of one of Y and Nd, a content of the first additional element being not less than 0.3 wt. % and not more than 3 wt. %, as in the fourth aspect of the invention. If the content of the first additional element is less than 0.3 wt. %, the precipitates are not sufficiently produced, and the suppression of the grain growth is difficult. On the other hand, if the content of the first additional element becomes greater than 3 wt. %, the content of Ni in the electrode material declines, so that the deformation resistance becomes high, and it becomes difficult to work this electrode material as the center electrode or the ground electrode. It should be noted that to obtain excellent workability, the Ni content in the electrode material should preferably be set to not less than 97 wt. %.

In addition, if the intermetallic compound contains as the second additional element at least one element selected from the group consisting of Si, Ti, Ca, Sc, Sr, Ba, and Mg as in the fifth aspect of the invention, it is possible to further suppress the oxidation of the electrode material while suppressing the grain growth, as described above. The reason is that if the second additional element is contained in the electrode material by an infinitesimal amount, oxides are formed at the grain boundaries in the surface layer of the electrode material, and the formation of these oxides makes it difficult for oxygen in the outside to enter the interior through the grain boundaries. It should be noted a plurality of kinds of such second additional elements may be added simultaneously.

Preferably, the content of the second additional element in the electrode material is less than 1 wt. %, as in the sixth aspect of the invention. In particular, the second additional element of the electrode material may be Si, and its content may be less than 0.3 wt. %, as in the seventh aspect of the invention. In the case of Si, in particular, among the second additional elements, the ingress depth of oxygen tends to stay relatively shallowly with respect to other second additional elements. Meanwhile, from the perspective of the spark wear resistance of the electrode material, the higher the proportion of the Ni component, the more preferable, and it is possible to obtain an effect by using Si whose effect is noticeable in comparison with other second additional elements irrespective of the issue of the content. As a result, it is possible to reduce the content of the second additional element in the electrode material, and it is possible to form an electrode material in which the proportion of the Ni component is relatively high. It should be noted that if the content of the second additional element becomes greater than 1 wt. %, the specific resistance of the electrode material becomes high, and the thermal conductivity becomes low, so that sufficient heat dissipation cannot be effected, possibly resulting in a decline in the spark wear resistance.

Incidentally, if the amount of oxides in the second additional element is large, these oxides are easily exfoliated from the parent phase of Ni, and if they are exfoliated, the ingress of oxygen along the grain boundaries cannot be suppressed, possibly causing the oxidation to progress. Accordingly, as in the eighth aspect of the invention, the content of the second additional element should preferably be smaller than the content of the first additional element, and as in the ninth aspect of the invention, the content of the first additional element should preferably be not less than 3 times the content of the second additional element.

To carry out effective oxidation prevention by the precipitation of the intermetallic compound of Ni and the first additional element in the parent phase of Ni and by the addition of the second additional element, it suffices if a mixture obtained by dissolving Ni, the first additional element, and the second additional element is used as a raw material at the time of fabrication of the electrode material. Namely, the first additional element is solidly dissolved in the parent phase of Ni, and the intermetallic compound of Ni and the first additional element of the portion which exceeded the limit of solid solution is formed by precipitation. By so doing, it is possible to fabricate an electrode material excelling in the mechanical strength as compared with a case where powders of raw materials are mixed and quench-hardened, and it is possible to reduce the amount of oxygen dissolved in the interior. To suppress the internal corrosion of the electrode material and maintain the mechanical strength, the amount of oxygen dissolved in the electrode material should preferably not more than 30 ppm according to Example 5 which will be described later.

In addition, when the electrode fabricated from such an electrode material is used by constituting the spark plug, the electrode is exposed to a high-temperature atmosphere of 1000° C. or more, and the environment is harsh where the spark discharge is effected, so that it is essential to suppress the grain growth of crystal grains in the oxidation suppression. To obtain sufficient high-temperature oxidation resistance, as in the 12th aspect of the invention, it is preferable to adjust the composition of the electrode material such that the average grain size of crystal grains after being held for 72 hours at 1000° C. is not more than 300 μm. The electrode in which the grain growth is likely to progress when it is exposed to such a high-temperature atmosphere is the ground electrode which is disposed at a position closer to the center of the combustion chamber. For this reason, as in the 15th aspect of the invention, the ground electrode is preferably formed of the electrode material in accordance with the invention.

In addition, to enhance the heat dissipation performance of the electrode material which is fabricated from the electrode material and effectively increase the spark wear resistance, it is preferable to adjust the composition of the electrode material such that its specific resistance at normal temperature (20 to 25° C.) becomes not more than 15 μΩcm, as in the 13th aspect of the invention. The lower the specific resistance, the more the heating value accompanying the spark discharge of the electrode fabricated from this electrode material can be suppressed. To lower the specific resistance, it is necessary to reduce the content of the second additional element, and if that content becomes small, the thermal conductivity of the electrode material improves, so that it is possible to enhance the heat dissipation performance when the electrode material is used for the electrode, thereby making it possible to enhance the spark wear resistance.

In addition, if a ratio ($\sigma 0.2/\sigma B$) of 0.2% proof stress ($\sigma 0.2$) to tensile strength ($\sigma B$) is not less than 0.4 and not more than 0.6, as in the 14th aspect of the invention, the intermetallic compounds are distributed finely and uniformly, and it is possible to increase the high-temperature oxidation resistance. If $\sigma 0.2/\sigma B$ is less than 0.4, the distribution of the intermetallic compounds becomes insufficient, possibly resulting in a decline in the high-temperature oxidation resistance. On the other hand, if $\sigma 0.2/\sigma B$ exceeds 0.6, its effect is saturated and the deformation resistance during working becomes large, so that there is a possibility that desirable workability cannot be obtained as the electrode material.

DESCRIPTION OF REFERENCE NUMERALS AND SIGNS

20: center electrode
30: ground electrode
100: spark plug

DETAILED DESCRIPTION OF THE INVENTION

Figure 1:
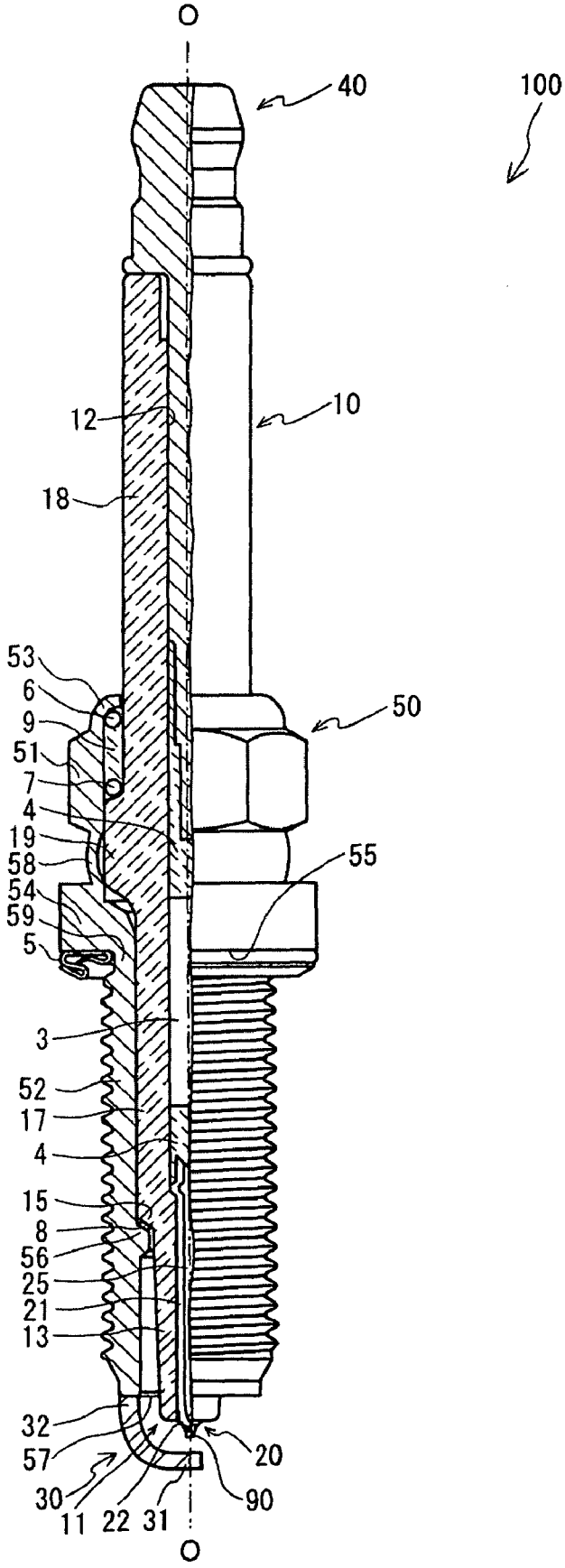
FIG. 1 is a partial cross-sectional view of a spark plug 100.

Referring now to the drawings, a description will be given of an embodiment of a spark plug in accordance with the invention. First, referring to FIG. 1, a description will be given of the structure of a spark plug 100 as one example. FIG. 1 is a partial cross-sectional view of the spark plug 100. It should be noted that a description will be given by assuming that, in FIG. 1, the direction of an axis O of the spark plug 100 is a vertical direction in the drawing, and that the lower side of the drawing is a leading end side and the upper side is a rear end side thereof. As shown in FIG. 1, the spark plug 100 is generally comprised of an insulator 10; a metal shell 50 for holding this insulator 10; a center electrode 20 held in the insulator 10 in the direction of the axis O; a ground electrode 30 whose proximal end 32 is welded to a leading end face 57 of the metal shell 50 and in which one side surface of its leading end portion 31 opposes a leading end portion 22 of the center electrode 20; and a metallic terminal 40 provided at a rear end portion of the insulator 10.

First, a description will be given of the insulator 10 of this spark plug 100. As is generally known, the insulator is formed by sintering alumina or the like and has a cylindrical shape in which the axial hole 12 extending in the direction of the axis O is formed at the axial center. A collar portion 19 having a largest outside diameter is formed substantially in the center in the direction of the axis O, and a rear-end side trunk portion 18 is formed rearwardly of the same (on the upper side in FIG. 1). A leading-end side trunk portion 17 having a smaller outside diameter than the rear-end side trunk portion 18 is formed forwardly of the collar portion (on the lower side in FIG. 1). Further, a long leg portion having a smaller outside diameter than the leading-end side trunk portion 17 is formed forwardly of that leading-end side trunk portion 17. The long leg portion 13 has a gradually reduced diameter toward the leading end side, and when the spark plug 100 is mounted in an engine head (not shown) of the internal combustion engine, the long leg portion 13 is exposed to the interior of its combustion chamber. Additionally, a portion between the long leg portion 13 and the rear-end side trunk portion 18 is formed as a stepped portion 15.

Next, a description will be given of the center electrode 20. The center electrode 20 is a rod-like electrode having a structure in which a core material 25 is embedded in an electrode base metal 21 formed of a nickel-based alloy such as Inconel (trade name) 600 or 601 having nickel as a principal component, the core material 25 being formed of copper or an alloy having copper as a principal component, which excel in thermal conductivity more than the electrode base metal 21. The leading end portion 22 of the center electrode 20 protrudes from a leading end portion 11 of the insulator 10 and is formed to have a smaller diameter toward the leading end side. An electrode tip 90 formed of a precious metal is welded to a leading end face of the leading end portion 22 to improve spark wear resistance. The center electrode 20 extends toward the rear end side inside the axial hole 12 and is electrically connected to the metallic terminal 40 on the rear side (upper side in FIG. 1) through a seal body 4 and a ceramic resistor 3. A high-tension cable (not shown) is connected to this metallic terminal 40 through a plug cap (not shown), and a high voltage is adapted to be applied thereto.

Next, a description will be given of the metal shell 50. The metal shell 50 is a cylindrical fitting for fixing the spark plug 100 to the engine head (not shown) of the internal combustion engine, and holds within its interior the insulator 10 in such a manner as to surround its portion extending from a portion of the rear-end side trunk portion 18 to the long leg portion 13. The metal shell 50 is formed of low carbon steel and has a tool engagement portion 51 with which an unillustrated spark plug wrench is engaged and a mounting threaded portion 52 having a thread formed thereon for mounting to the engine head of the internal combustion engine.

Further, a collar-like seal portion 54 is formed between the tool engagement portion 51 and the mounting threaded portion 52 of the metal shell 50. An annular gasket 5 formed by bending a plate body is fitted on a thread neck 59 between the mounting threaded portion 52 and the seal portion 54. The gasket 5 is deformed by being pressed and crushed between the engine head (not shown) to which the spark plug 100 is mounted and a bearing surface 55 of the seal portion 54, and seals the gap therebetween, to thereby prevent a gastightness failure within the engine through the mounting portion of the spark plug 100.

A thin-walled caulked portion 53 is provided rearwardly of the tool engagement portion 51, and a buckled portion 58 which is thin-walled in the same way as the caulked portion 53 is provided between the seal portion 54 and the tool engagement portion 51. Further, annular ring members 6 and 7 are interposed between an inner peripheral surface of the metal shell 50 and an outer peripheral surface of the rear-end side trunk portion 18 of the insulator 10, and a powder of talc 9 is filled between the both ring members 6 and 7. As the caulked portion 53 is caulked in such a way as to be bent inwardly, the insulator 10 is pressed toward the leading end side inside the metal shell 50 through the ring members 6 and 7 and the talc 9. As a result, the stepped portion 15 of the insulator 10 is supported through an annular plate packing 8 by a stepped portion 56 formed at the position of the mounting threaded portion 52 on the inner periphery of the metal shell 50, thereby integrating the metal shell 50 and the insulator 10. At this time, the gas-tightness between the metal shell 50 and the insulator 10 is maintained by the plate packing 8, thereby preventing the efflux of the combustion gases. In addition, at the time of caulking, the buckled portion 58 is adapted to be deformed outwardly in consequence of the application of the compressive force, and enhances the gas-tightness of the interior of the metal shell 50 while gaining a compression stroke for the talc 9.

Next, a description will be given of the ground electrode 30. The ground electrode 30 is a rod-like electrode which is formed of an Ni-based alloy having Ni as a principal component and has a substantially rectangular longitudinal cross section. The ground electrode 30 is welded at its proximal end portion 32 to the leading end portion 57 of the metal shell 50, and is bent such that one side surface of its leading end portion 31 opposes the leading end portion 22 of the center electrode 20. In addition, a spark discharge gap is formed between the ground electrode 30 and the center electrode 20 (in this embodiment, between the ground electrode 30 and the electrode tip 90 provided at the leading end portion 22 of the center electrode 20).

When the spark plug 100 having such a structure is mounted in the unillustrated engine head, the leading end side of the center electrode 20 and the ground electrode 30 are exposed to the interior of the combustion chamber (not shown). During the driving of the engine, a spark discharge is repeatedly effected between the ground electrode 30 and the center electrode 20, and the center electrode 20 and the ground electrode 30 are exposed to high temperatures close to 1000° C. at that time. Since the center electrode 20 and the ground electrode 30 are used in such a harsh environment, as an electrode material for constituting the center electrode 20 and the ground electrode 30, it is preferable to use a material which excels in high-temperature oxidation resistance and spark wear resistance although Ni which is easy to work and has a small specific resistance is used. Accordingly, in this embodiment, as the electrode material for constituting the center electrode 20 and the ground electrode 30, a material in which intermetallic compounds are precipitated at least in grain boundaries is used.

The intermetallic compound is a compound in which two or more kinds of metallic elements are combined, and even if such an intermetallic compound is precipitated in the electrode material, since oxygen is not included in the compound, internal corrosion is unlikely to occur even if it is used in a high-temperature environment. Although there are cases where the electrode material is recrystallized and grain growth occurs in a harsh environment in which a load accompanying the spark discharge which is effected at high temperature is applied, the intermetallic compound precipitated at least in the grain boundary suppresses the grain growth as so-called pinning. If the grain growth can be suppressed, the grain size of the crystal grains is maintained in a small state. Therefore, on the ground that the structure of the grain boundary is maintained in a relatively complex state, even if oxygen enters the interior of the electrode material from the outside along the grain boundaries, the ingress depth does not become deep, so that it is possible to obtain a sufficient effect with respect to the suppression of oxidation.

Figure 2:
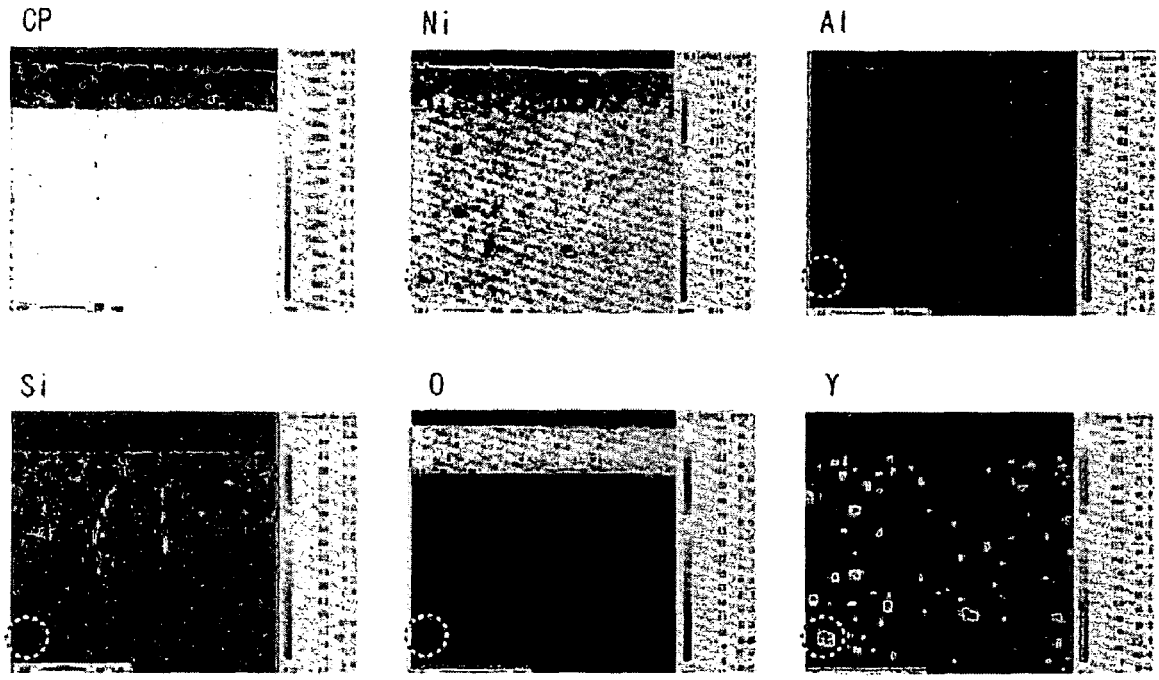
FIG. 2 is a cross-sectional micrograph (CP) of a predetermined portion of the electrode material and illustrates the results of measurement of concentration distribution conducted with respect to the respective elements of Ni, Al, Si, O, and Y in that field of view by using an electron probe microanalyzer (EPMA)

Here, FIG. 2 shows a cross-sectional micrograph (CP) of a predetermined portion of the electrode material and the results of measurement of concentration distribution conducted with respect to the respective elements of Ni, Al, Si, O, and Y in that field of view by using an electron probe microanalyzer (EPMA). As shown in FIG. 2, only Ni and Y were detected in the portion (identical portion) surrounded by the dotted line, for example. However, the precipitation was not noted in that portion in the case of Al, Si, and O. This fact shows that the precipitate in the electrode material is a compound consisting of Ni and Y, i.e., a Ni—Y intermetallic compound. In addition, in FIG. 2, a state is noted in which such an intermetallic compound is precipitated in various portions regardless of whether it is located intergranularly or intragranularly.

According to Example 2, which will be described later, such an intermetallic compound is preferably constituted by a compound of Ni contained as a principal component and a rare earth element, and it is more preferably a compound containing at least Ni and Y or a compound containing at least Ni and Nd. Further, it has been found from the results of Example 3, which will be described later, that Ni is used as a principal component, and not less than 0.3 wt. % and not more than 3 wt. % of either element of Y or Nd is contained as a first additional element. If the amount of the first additional element contained is less than 0.3 wt. %, a sufficient precipitation is not produced, the suppression of the grain growth is difficult. On the other hand, if the amount of the first additional element contained becomes greater than 3 wt. %, the Ni content of the electrode material becomes low, so that deformation resistance becomes high, and it becomes difficult to process this electrode material as the center electrode 20 or the ground electrode 30. It should be noted that, to obtain excellent workability, it is preferable to set the Ni content of the electrode material to not less than 97 wt. %.

In addition, it has been found from the results of Example 4, which will be described later, that there is an effect in the oxidation suppression of the electrode material if at least one element selected from Si, Ti, Ca, Sc, Sr, Ba, and Mg is contained in the electrode material as a second additional element, while suppressing the grain growth, as described above. If such a second additional element is contained in the electrode material by an infinitesimal amount, oxides are formed at the grain boundaries in the surface layer of the electrode material, and as the formation of these oxides makes it difficult for oxygen in the outside to enter the interior through the grain boundaries, so that the oxidation of the electrode material can be further suppressed. It has been found from Example 4 that the content of the second additional element in the electrode material should preferably be less than 0.3 wt. %, and, in particular, if the second additional element is Si and its content is less than 0.3 wt. %, the oxidation of the second additional element occurs intergranularly, and intragranular oxidation can be suppressed, that it is more effective. On the other hand, if the content of the second additional element becomes greater than 1 wt. %, the specific resistance of the electrode material becomes high, and the thermal conductivity becomes low, so that sufficient heat dissipation cannot be effected, possibly resulting in a decline in the spark wear resistance.

In addition, if the amount of oxides in the second additional element is large, these oxides are easily exfoliated from the parent phase of Ni, and if they are exfoliated, the ingress of oxygen along the grain boundaries cannot be suppressed, possibly causing the oxidation to progress. Accordingly, the content of the second additional element should preferably be smaller than the content of the first additional element, and according to Example 3 the content of the first additional element should preferably be not less than 3 times the content of the second additional element.

Figure 3:
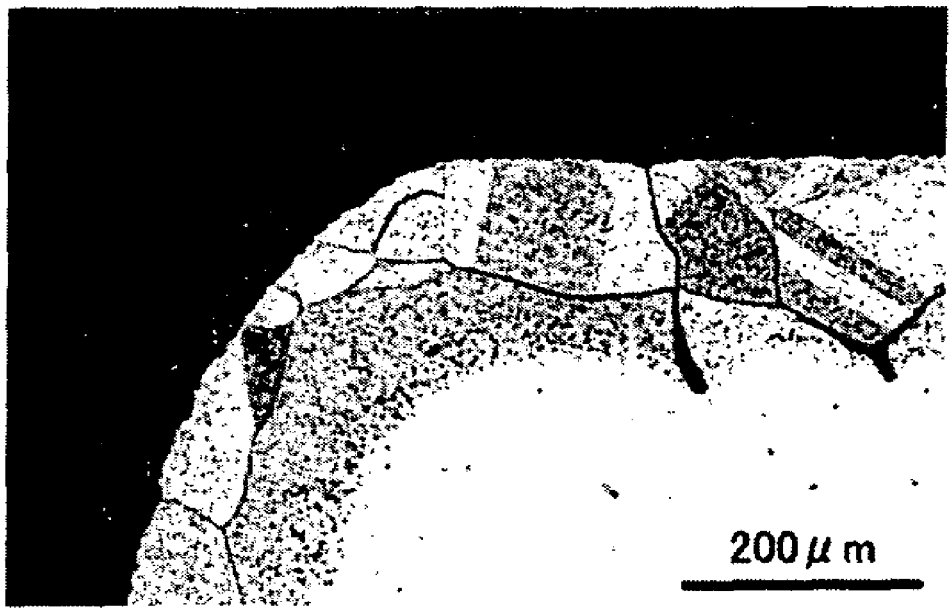
FIG. 3 is a cross-sectional micrograph illustrating an oxidized state of an Ni material after being held for 72 hours at 1000° C.
Figure 4:
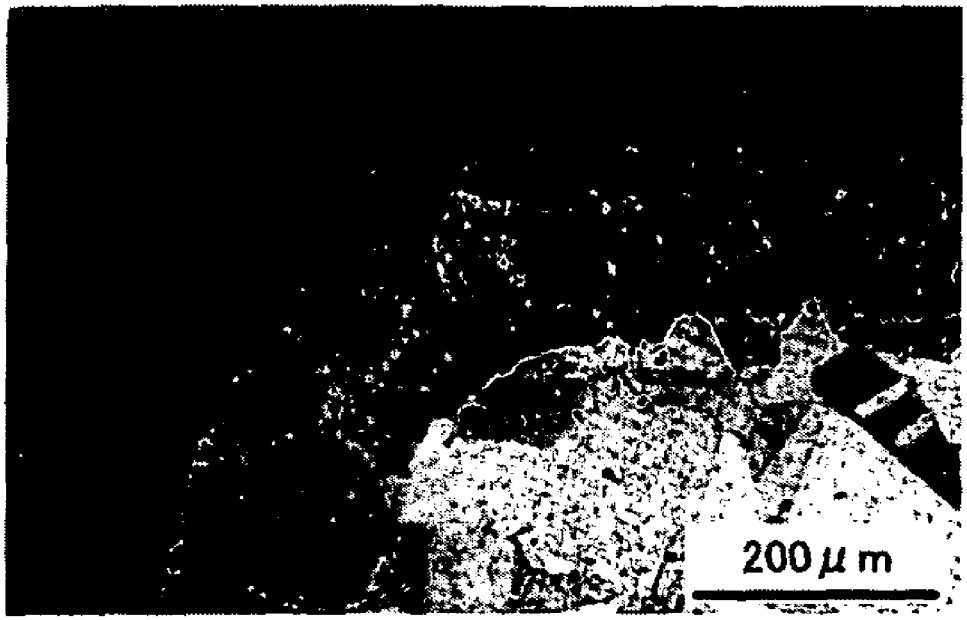
FIG. 4 is a cross-sectional micrograph illustrating an oxidized state of a conventional electrode material, which contained Ni as a principal component and contained oxides of a first additional element, after being held for 72 hours at 1000° C.
Figure 5:
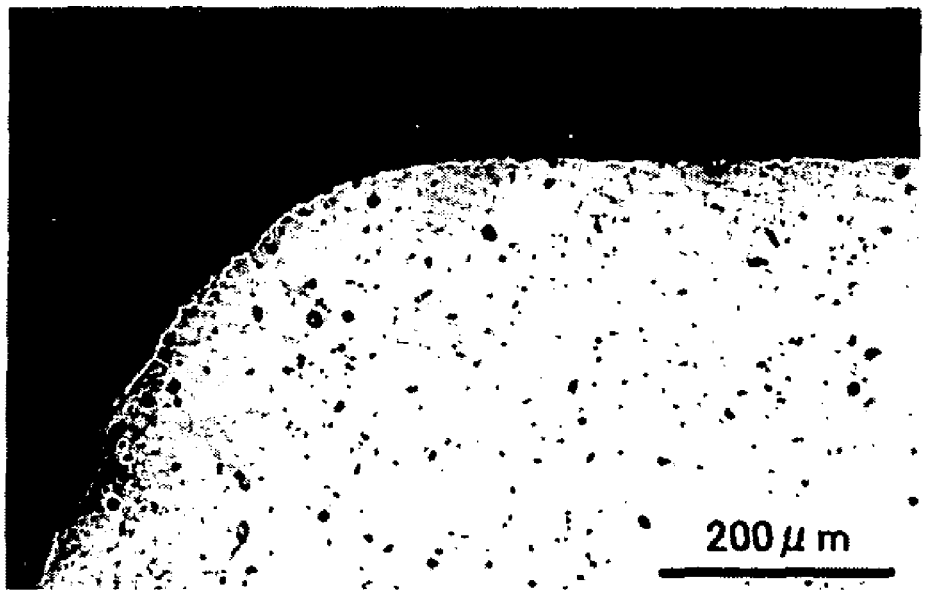
FIG. 5 is a cross-sectional micrograph illustrating an oxidized state of an electrode material of this embodiment, which contained Ni as a principal component and in which intermetallic compounds precipitated, after being held for 72 hours at 1000° C.

Thus, as for the electrode material in accordance with this embodiment, on the ground that the intermetallic compound of Ni and the first additional element precipitates in the parent phase to suppress the grain growth, and oxides of the second additional element are formed at the grain boundaries in the surface layer, it is possible to suppress the ingress of oxygen through the grain boundaries and the internal corrosion due to the inclusion of oxides in the interior. This is apparent from comparative cross-sectional micrographs of electrode materials shown in FIGS. 3 to 5. FIG. 3 is a cross-sectional micrograph illustrating an oxidized state of an Ni material after being held for 72 hours at 1000° C. FIG. 4 is a cross-sectional micrograph illustrating an oxidized state of a conventional electrode material, which contained Ni as a principal component and contained oxides of the first additional element, after being held for 72 hours at 1000° C. FIG. 5 is a cross-sectional micrograph illustrating an oxidized state of an electrode material of this embodiment, which contained Ni as a principal component and in which intermetallic compounds precipitated, after being held for 72 hours at 1000° C.

As shown in FIG. 3, as for the Ni material, crystal grains coarsened due to the grain growth, and the grain boundary structure became simple. Further, the state can be seen in which the outside oxygen entered the interior of the Ni material along these grain boundaries, and oxidation consequently progressed to a deep depth portion from the surface layer. In addition, as shown in FIG. 4, as for the conventional electrode material, although the coarsening of the crystal grains was suppressed in comparison with the Ni material, the surface oxidized layer was divided into two layers, and exfoliation occurred at the interface thereof. In the case of the conventional electrode material, the content of Si or Al as the second additional element was greater that in the case of the electrode material of this embodiment, and the exfoliation occurred due to the difference between the coefficient of thermal expansion of their oxides and the coefficient of thermal expansion of Ni constituting the parent phase. The state can be seen in which the ingress of oxygen into the interior was facilitated by this exfoliation, and hence the oxidation progressed. In addition, voids were formed by the out diffusion of metal ions in the oxides of the precipitated first additional element, and the contact area of the both layers at the interface decreased, promoting the progress of exfoliation. On the other hand, in the case of the electrode material of this embodiment, on the ground that the content of the second additional element was smaller than that of the conventional electrode material, its oxides were formed only at the grain boundaries, and the ingress of oxygen into the interior along the grain boundaries was hampered by these oxides. In addition, the first additional element in the intermetallic compound precipitated at the grain boundaries forms at the grain boundaries oxides together with a small amount of oxygen which entered, and these oxides suppress the formation of voids by preventing the out diffusion of metal ions and render the shape of the interface intricate, thereby suppressing the occurrence of the exfoliation. Further, on the ground that the coarsening of the crystal grins is suppressed by the intermetallic compound, the ingress of oxygen into the interior along the grain boundaries is sufficiently suppressed, and the progress of oxidation in the interior of the electrode material is sufficiently suppressed.

To carry out effective oxidation prevention by the precipitation of the intermetallic compound of Ni and the first additional element in the parent phase of Ni and by the addition of the second additional element, it suffices if a mixture obtained by dissolving Ni, the first additional element, and the second additional element is used as a raw material at the time of fabrication of the electrode material. Namely, the first additional element is solidly dissolved in the parent phase of Ni, and the intermetallic compound of Ni and the first additional element of the portion which exceeded the limit of solid solution is formed by precipitation. By so doing, it is possible to fabricate an electrode material excelling in the mechanical strength as compared with a case where powders of raw materials are mixed and quench-hardened, and it is possible to reduce the amount of oxygen dissolved in the interior. To suppress the internal corrosion of the electrode material and maintain the mechanical strength, the amount of oxygen dissolved in the electrode material should preferably not more than 30 ppm according to Example 5 which will be described later.

Next, according to Example 3 which will be described later, the composition of the electrode material should preferably be adjusted such that the average grain size of crystal grains after such an electrode material is held for 72 hours at 1000° C. becomes not more than 300 μm. If the electrode material is such that the average grain size of crystal grains after such an electrode material is held for 72 hours at 1000° C. becomes greater than 300 μm, the structure of the grain boundaries becomes simple, the ingress of oxygen along the grain boundaries is facilitated, and the ingress depth becomes deep, so that a sufficient suppression effect is difficult to obtain with respect to the oxidation.

In addition, according to Example 6 which will be described later, if the specific resistance at normal temperature becomes not more than 15 μΩcm, the heat dissipation performance of the center electrode 20 and the ground electrode 30 which are fabricated from the electrode material is enhanced, and the spark wear resistance can be improved. The lower the specific resistance, the more the heating value accompanying the spark discharge of the center electrode 20 and the ground electrode 30 fabricated from this electrode material can be suppressed. To lower the specific resistance, it is necessary to reduce the content of the second additional element, and if that content becomes small, the thermal conductivity of the electrode material improves, so that it is possible to enhance the heat dissipation performance when the electrode material is used for the center electrode 20 and the ground electrode 30, thereby making it possible to enhance the spark wear resistance.

Then, according to Example 7 which will be described later, if a ratio (σ0.2/σB) of 0.2% proof stress (σ0.2) to tensile strength (σB) is not less than 0.4 and not more than 0.6, the intermetallic compounds are distributed finely and uniformly, and it is possible to increase the high-temperature oxidation resistance. If σ0.2/σB is less than 0.4, the distribution of the intermetallic compounds becomes insufficient, possibly resulting in a decline in the high-temperature oxidation resistance. On the other hand, if σ0.2/σB exceeds 0.6, its effect is saturated and the deformation resistance during working becomes large, so that there is a possibility that desirable workability cannot be obtained as the electrode material.

An evaluation test was conducted to confirm that the high-temperature oxidation resistance and the spark wear resistance can be satisfied by defining the contained elements and contents of the electrode materials constituting the center electrode 20 and the ground electrode 30 of the spark plug 100.

Example 1

In Example 1, confirmation was made as to whether or not the high-temperature oxidation resistance of the electrode material is affected by precipitates in the parent phase of Ni. In fabricating Samples 111 to 113 of the electrode materials, a raw material was used in which 0.45 wt. % of Y as the first additional element and 0.15 wt. % of Si as the second additional element were added to 99.40% wt. % of Ni, and this raw material was melted and cast by using a vacuum melting furnace to form an ingot. Subsequently, Samples 111 to 113 of the electrode materials were fabricated by using wires obtained through hot working and wire drawing and having a cross-sectional size of 1.3×2.7 mm. Further, in fabricating Samples 114 and 115, a raw material was used in which 0.50 wt. % of Nd as the first additional element and 0.15 wt. % of Si as the second additional element were added to 99.35% wt. % of Ni, and this raw material was melted and cast by using a vacuum melting furnace to form an ingot. Subsequently, Samples 114 and 115 of the electrode materials were similarly fabricated by using wires obtained through hot working and wire drawing and having a cross-sectional size of 1.3×2.7 mm. Precipitates in the parent phase of Ni differed in the respective samples. Specifically, intermetallic compounds (Ni—Y) of Ni and Y precipitated in Sample 111, and oxides ($Y_2O_3$) precipitated in Sample 112, and nitrides (YN) precipitated in Sample 113. In addition, intermetallic compounds (Ni—Nd) of Ni and Nd precipitated in Sample 114, and oxides ($Nd_2O_3$) precipitated in Sample 115.

In this evaluation test, spark plugs which were completed by assembling ground electrodes fabricated by using the respective Samples 111 to 115 (electrode materials) were respectively mounted in an engine for testing (displacement of 2000 cc, 6-cylinder), and an endurance test was conducted in which operation for 1 minute at full throttle and for 1 minute in an idling state was repeated for 100 hours. Then, after the endurance test, cross-sectional micrographs of the ground electrodes (electrode materials) such as the one shown in FIG. 5 referred to above were taken, the depth of the oxidized region from the surface layer was respectively measured, and an evaluation of the high-temperature oxidation resistance was made. It should be noted that criteria of evaluation of the high-temperature oxidation resistance in the respective tables which will be explained below, including Table 1, are as follows. In a case where the thickness of the oxidized region from the surface layer was less than 100 μm, the high-temperature oxidation resistance substantially improved over conventional products and was therefore evaluated as "excellent." In a case where the thickness was not less than 100 μm and less than 150 μm, the high-temperature oxidation resistance showed improvement over the conventional products and was evaluated as "good." Further, in a case where the thickness was not less than 150 μm and less than 200 μm, the high-temperature oxidation resistance showed slight improvement over the conventional products and was hence evaluated as "relatively poor." In a case where the thickness was 200 μm or more, the high-temperature oxidation resistance was comparable to that of the conventional products and was therefore evaluated as "not good." The results of this evaluation test are shown in Table 1 below.

TABLE 1

| Sample | Ni Content (wt. %) | 1st Additional Element (wt. %) | | 2nd Additional Element (wt. %) | | Precipitate | Amount of Dissolved Oxygen (ppm) | σ0.2/σB | High-Temperature Oxidation Resistance |
|---|---|---|---|---|---|---|---|---|---|
| 111 | 99.40 | Y | 0.45 | Si | 0.15 | Ni—Y | 15 | 0.55 | excellent |
| 112 | 99.40 | Y | 0.45 | Si | 0.15 | $Y_2O_3$ | 15 | 0.55 | not good |
| 113 | 99.40 | Y | 0.45 | Si | 0.15 | YN | 15 | 0.55 | not good |
| 114 | 99.35 | Nd | 0.50 | Si | 0.15 | Ni—Nd | 15 | 0.55 | good |
| 115 | 99.35 | Nd | 0.50 | Si | 0.15 | $Nd_2O_3$ | 15 | 0.55 | not good |

As a result of this evaluation test, in Samples 112, 113, and 115 in which oxides ($Y_2O_3$, $Nd_2O_3$) or nitrides (YN) precipitated, the high-temperature oxidation resistance was comparable to that of conventional products, and was respectively evaluated as "not good." On the other hand, in Sample 111 in which the intermetallic compound (Ni—Y) precipitated, the high-temperature oxidation resistance substantially improved over the conventional products (evaluation: "excellent"). In addition, in Sample 114 in which the intermetallic compound (Ni—Nd) precipitated, a good result was obtained as the high-temperature oxidation resistance (evaluation: "good").

Example 2

Further, an evaluation test similar to that of Example 1 was conducted by using other elements as the first additional element. In fabricating each of Samples 211 to 214 of the electrode materials, a raw material was used in which 0.50 wt. % of the first additional element and 0.15 wt. % of Si as the second additional element were added to 99.35% wt. % of Ni, and this raw material was melted and cast by using the vacuum melting furnace to form an ingot in the same way as in Example 1. Subsequently, Samples 211 to 214 of the electrode materials were fabricated by using wires obtained through hot working and wire drawing and having a cross-sectional size of 1.3×2.7 mm. It should be noted that, in Samples 211 to 213, Ho, Gd, and Sm were respectively used as the first additional element, and intermetallic compounds (Ni—Ho, Ni—Gd, and Ni—Sm) respectively precipitated in the formed electrode materials. In addition, in Sample 214, two kinds, Y and Nd, were added as the first additional elements, and two kinds of intermetallic compounds, Ni—Y and Ni—Nd, precipitated in the formed electrode materials. Then, in a similar testing method to that of Example 1, an evaluation was made of the high-temperature oxidation resistance of the respective samples. The results of this evaluation test are shown in Table 2 below.

TABLE 2

| Sample | Ni Content (wt. %) | 1st Additional Element (wt. %) | | 2nd Additional Element (wt. %) | | Precipitate | Amount of Dissolved Oxygen (ppm) | σ0.2/σB | High-Temperature Oxidation Resistance |
|---|---|---|---|---|---|---|---|---|---|
| 211 | 99.35 | Ho | 0.50 | Si | 0.15 | Ni—Ho | 15 | 0.55 | relatively poor |
| 212 | 99.35 | Gd | 0.50 | Si | 0.15 | Ni—Gd | 15 | 0.55 | relatively poor |
| 213 | 99.35 | Sm | 0.50 | Si | 0.15 | Ni—Sm | 15 | 0.55 | relatively poor |
| 214 | 99.35 | Y<br>Nd | 0.50 | Si | 0.15 | Ni—Y<br>Ni—Nd | 15 | 0.55 | good |
| 111 | 99.40 | Y | 0.45 | Si | 0.15 | Ni—Y | 15 | 0.55 | excellent |
| 114 | 99.35 | Nd | 0.50 | Si | 0.15 | Ni—Nd | 15 | 0.55 | good |

It was found that, in the electrode materials in which intermetallic compounds of Ni and the first additional element precipitated as in Samples 211 to 213 shown in Table 2, the high-temperature oxidation resistance improved, though slightly, over the conventional products (evaluation: "relatively poor"). The first additional elements added in these samples, including those of the above-described Samples 111 and 114 (see Table 1), were respectively rare earth elements. Thus, it was able to confirm that if electrode materials are formed in which intermetallic compounds including at least Ni and a rare earth element are precipitated in the parent phase of Ni, it is possible to obtain an effect in the high-temperature oxidation resistance. In addition, in Sample 214, two kinds of intermetallic compounds, including Ni—Y and Ni—Nd, precipitated, and in this case as well a satisfactory result was obtained in the high-temperature oxidation resistance (evaluation: "good"). Accordingly, it was found that, as the electrode material, it suffices if those are used in which at least one or more kinds of intermetallic compounds are precipitated in the parent phase of Ni.

Example 3

Next, an evaluation test was conducted to confirm the effect exerted by the content of the first additional element on the grain growth of crystal grains of the electrode materials. As for Samples 311 to 319 of the electrode materials, Y was added as the first additional element, and its content was varied, while the content of Si, which is added as the second additional element, was set to 0.15 wt. %, and the content of Ni was adjusted so that the balance is Ni. Specifically, in Samples 311 to 319, the content of Y as the first additional element was set in sequence to 4.00, 3.00, 2.00, 1.00, 0.45, 0.30, 0.10, 0.05, and 0.00 (wt. %), while the content of Ni was set in sequence to 95.85, 96.85, 97.85, 98.85, 99.40, 99.55, 99.75, 99.80, and 99.85 (wt. %). Through this adjustment, the content ratio (the content of the first additional element/the content of the second additional element) between the first additional element and the second additional element in Samples 311 to 319 became in sequence 26.67, 20.00, 13.33, 6.67, 3.00, 2.00, 0.67, 0.33, and 0.00.

Subsequently, Samples 213 to 319 were respectively worked into a rod shape with 1.3×2.7×20 (mm), and were held for 72 hours at 1000° C. End portions of the respective Samples 312 to 319 were cut, and cross-sectional micrographs such as those shown in FIG. 5 were taken. The average grain size of the crystal grains was confirmed to be in sequence 50, 50, 50, 50, 300, 350, 400, and 430 (μm). It should be noted that as for Sample 311, its evaluation was abandoned on the ground that its hardness was high and it was difficult to work.

Furthermore, a weight of 40 g was attached to a longitudinal end of each of Samples 312 to 319. In this state, the respective Samples 312 to 319 were set on a vibration testing machine, and after applying vibrations for a fixed time duration, the states of the respective samples were examined. In this vibration test, the acceleration applied to the samples was fixed to 5 G, the frequency was varied at a fixed rate of change from 50 Hz to 200 Hz in 30 seconds and was varied at a fixed rate of change from 200 Hz to 50 Hz in another 30 seconds, and this cycle was repeated for 20 minutes. After the test, in a case where the sample was broken, the sample was evaluated as "not good" on the ground that it was undesirable in the breakage resistance. In a case where although breakage did not result, cracking occurred, the sample was evaluated as "relatively poor" on the ground that sufficient breakage resistance cannot be obtained. In addition, in a case where breakage or cracking did not occur in the sample, the sample was evaluated as "good" on the ground that its breakage resistance was satisfactory. Further, in a case where even if a 20-minute additional test was conducted, no breakage or cracking occurred, the sample was evaluated as "excellent" on the ground that it excelled in the breakage resistance. The results of this evaluation test are shown in Table 3 below.

TABLE 3

| Sample | Ni Content (wt. %) | 1st Additional Element (wt. %) | | 2nd Additional Element (wt. %) | | (Content of 1st Additional Element/ (Content of 2nd Additional Element) | Average Grain Size After Heating (μm) | Breakage resistance |
|---|---|---|---|---|---|---|---|---|
| 311 | 95.85 | Y | 4.00 | Si | 0.15 | 26.67 | (difficult to work) | |
| 312 | 96.85 | Y | 3.00 | Si | 0.15 | 20.00 | 50 | excellent |
| 313 | 97.85 | Y | 2.00 | Si | 0.15 | 13.33 | 50 | excellent |
| 314 | 98.85 | Y | 1.00 | Si | 0.15 | 6.67 | 50 | excellent |
| 315 | 99.40 | Y | 0.45 | Si | 0.15 | 3.00 | 50 | excellent |
| 316 | 99.55 | Y | 0.30 | Si | 0.15 | 2.00 | 300 | good |
| 317 | 99.75 | Y | 0.10 | Si | 0.15 | 0.67 | 350 | relatively poor |
| 318 | 99.80 | Y | 0.05 | Si | 0.15 | 0.33 | 400 | relatively poor |
| 319 | 99.85 | Y | 0.00 | Si | 0.15 | 0.00 | 430 | not good |

As shown in Table 3, in Sample 311 in which the content of the first additional element (Y) was set to 4.00 wt. %, the content of Ni decreased to 95.85 wt. %, so that it become impossible to maintain the excellent workability of Ni, and the sample became hard and became difficult to work. Therefore, it was found that Sample 311 is not suitable for use as the electrode material. In addition, in Samples 317 and 318 in which the content of Y was less than 0.30 wt. %, cracking occurred (evaluation: "relatively poor"), and breakage occurred in Sample 319 (evaluation: "not good"). In these samples, because the contents of Y were insufficiently small and the intermetallic compounds did not sufficiently precipitate, the effect of suppression of grain growth dimmed. For this reason, it is thought that the oxidation suppression became insufficient, and that these samples underwent embrittlement (breakage resistance declined). Meanwhile, in Samples 312 to 316 with not less than 0.3 wt. % of Y, which content exceeded the limit of solid solution to allow intermetallic compounds to sufficiently precipitate, breakage or cracking did not occur, and the breakage resistance was excellent. In particular, in Samples 312 to 315 with a Y content of not less than 0.45 wt. %, breakage or cracking did not occur even through 40 minutes of the vibration test, and it was confirmed that these samples excelled in the breakage resistance (evaluation: "excellent") (evaluation of Sample 316: "good").

In addition, according to the results of this evaluation test, the trend was noted that the more the Y content increased, the more the breakage resistance improved. However, according to Example 4 which will be described later, it is desirable to decrease the content of the second additional element. Accordingly, if attention is focused on the content of the first additional element and the content of the second additional element, it was found that excellent breakage resistance was obtained in Samples 312 to 316 in which the content of the first additional element was greater than the content of the second additional element, and that the breakage resistance was insufficient in Samples 317 to 319 in which the content of the first additional element was smaller than the content of the second additional element. In Samples 312 to 315 in which particularly excellent breakage resistance was obtained, (content of first additional element/(content of second additional element) was not less than 3. From this fact, by focusing attention on the ratio between the content of the first additional element and the content of the second additional element, it was found that it suffices if the content of the first additional element is set to not less than 3 times the content of the second additional element.

In addition, according to the results of this evaluation test, in Samples 312 to 316 in which the breakage resistance was excellent, the average grain size of crystal grains after being held for 72 hours at 1000° C. was not more than 300 μm. Namely, it can be said that if the average grain size after heating of the electrode materials was not more than 300 μm, oxidation to such an extent as to produce breakage or cracking did not progress in the above-described vibration test.

Example 4

Next, an evaluation test was conducted to confirm the effect exerted by the kind and content of the second additional element on the progress in oxidation of the electrode materials. As for each of Samples 411 to 445 of the electrode materials fabricated in conducting this evaluation test, Ni was used as the principal component, and Y was contained as the first additional element to precipitate Ni—Y as the intermetallic compound. In Samples 411 to 413, Ti was used as the second additional element, and its content was set in sequence to 2.00, 1.00, and 0.50 (wt. %). Then, the contents of Ni and Y were respectively adjusted: in Sample 411, Ni was set to 97.00 wt. %, and Y was set to 1.00 wt. %; in Sample 412, Ni was set to 97.90 wt. %, and Y was set to 1.10 wt. %; and in Sample 413, Ni was set to 98.50 wt. %, and Y was set to 1.00 wt. %.

Similarly, In Samples 421 to 423, Ca was used as the second additional element, and its content was set in sequence to 2.00, 1.00, and 0.50 (wt. %). Then, the contents of Ni and Y were respectively adjusted: in Sample 421, Ni was set to 97.55 wt. %, and Y was set to 0.45 wt. %; in Sample 422, Ni was set to 98.00 wt. %, and Y was set to 1.00 wt. %; and in Sample 423, Ni was set to 98.50 wt. %, and Y was set to 1.00 wt. %.

Also, in Samples 431 to 435, Si was used as the second additional element, and its content was set in sequence to 2.00, 1.00, 0.35, 0.30, 0.15, and 0.05 (wt. %). Then, the contents of Ni and Y were respectively adjusted: in Sample 431, Ni was set to 97.55 wt. %, and Y was set to 0.45 wt. %; in Sample 432, Ni was set to 98.00 wt. %, and Y was set to 1.00 wt. %; in Sample 433, Ni was set to 99.20 wt. %, and Y was set to 0.45 wt. %; in Sample 434, Ni was set to 99.25 wt. %, and Y was set to 0.45 wt. %; and in Sample 435, Ni was set to 99.50 wt. %, and Y was set to 0.45 wt. %.

Meanwhile, in Samples 442 to 445, Sc, Sr, Ba, and Mg were used in sequence as the second additional element, and its content was set to 0.20 wt. %, respectively. It should be noted that the second additional element was not contained in Sample 441. Then, the contents of Ni and Y were respectively adjusted: in Sample 441, Ni was set to 99.55 wt. %, and Y was set to 0.45 wt. %; and in Samples 442 to 445, Ni was set to 99.35 wt. %, and Y was set to 0.45 wt. %. With respect to the respective Samples 411 to 445 which were formed to assume these compositions, an evaluation was made on the high-temperature oxidation resistance in a test method similar to that of Example 1. The results of this evaluation test are shown in Table 4 below.

TABLE 4

| Sample | Ni Content (wt. %) | 1st Additional Element (wt. %) | | 2nd Additional Element (wt. %) | | Precipitate | Amount of Dissolved Oxygen (ppm) | σ0.2/σB | High-Temperature Oxidation Resistance |
|---|---|---|---|---|---|---|---|---|---|
| 411 | 97.00 | Y | 1.00 | Ti | 2.00 | Ni—Y | 15 | 0.55 | relatively poor |
| 412 | 97.90 | Y | 1.10 | Ti | 1.00 | Ni—Y | 15 | 0.55 | good |
| 413 | 98.50 | Y | 1.00 | Ti | 0.50 | Ni—Y | 15 | 0.55 | good |
| 421 | 97.55 | Y | 0.45 | Ca | 2.00 | Ni—Y | 15 | 0.55 | relatively poor |
| 422 | 98.00 | Y | 1.00 | Ca | 1.00 | Ni—Y | 15 | 0.55 | good |
| 423 | 98.50 | Y | 1.00 | Ca | 0.50 | Ni—Y | 15 | 0.55 | good |
| 431 | 97.55 | Y | 0.45 | Si | 2.00 | Ni—Y | 15 | 0.55 | relatively poor |
| 432 | 98.00 | Y | 1.00 | Si | 1.00 | Ni—Y | 15 | 0.55 | good |
| 433 | 99.20 | Y | 0.45 | Si | 0.35 | Ni—Y | 15 | 0.55 | good |
| 434 | 99.25 | Y | 0.45 | Si | 0.30 | Ni—Y | 15 | 0.55 | excellent |
| 435 | 99.50 | Y | 0.45 | Si | 0.05 | Ni—Y | 15 | 0.55 | excellent |
| 441 | 99.55 | Y | 0.45 | — | — | Ni—Y | 15 | 0.55 | relatively poor |
| 442 | 99.35 | Y | 0.45 | Sc | 0.20 | Ni—Y | 15 | 0.55 | good |
| 443 | 99.35 | Y | 0.45 | Sr | 0.20 | Ni—Y | 15 | 0.55 | good |
| 444 | 99.35 | Y | 0.45 | Ba | 0.20 | Ni—Y | 15 | 0.55 | good |
| 445 | 99.35 | Y | 0.45 | Mg | 0.20 | Ni—Y | 15 | 0.55 | good |
| 111 | 99.40 | Y | 0.45 | Si | 0.15 | Ni—Y | 15 | 0.55 | excellent |

With regard to Samples 411 to 413 shown in Table 4, in Sample 411 in which the content of Ti added as the second additional element was set to 2.00 wt %, the improvement of the high-temperature oxidation resistance was slight (evaluation: "relatively poor"), but in Sample 412 in which the Ti content was decreased to 1.00 wt. % and in Sample 413 in which the Ti content was set to 0.50 wt. %, the high-temperature oxidation resistance was satisfactory (evaluation: "good"). Similar results were obtained also in Samples 421 to 423 in which Ca was used as the second additional element, and in Sample 421 in which the Ca content was set to 2.00 wt. %, the improvement of the high-temperature oxidation resistance was slight (evaluation: "relatively poor"), and in Samples 412 and 413 in which the Ca content was set to 1.00 and 0.50 (wt. %), respectively, the high-temperature oxidation resistance was satisfactory (evaluation: "good").

Further, similar results were obtained in Samples 431 to 435 and Sample 111 (see Table 1) in which Si was used as the second additional element. Namely, in Sample 431 in which the Si content was 2.00 wt. %, the improvement of the high-temperature oxidation resistance was slight (evaluation: "relatively poor"), and in Sample 432 in which the Si content was set to 1.00 wt. %, the high-temperature oxidation resistance was satisfactory (evaluation: "good"). Also in Sample 433 in which the Si content was set to 0.35 wt. %, the high-temperature oxidation resistance was satisfactory (evaluation: "good"). Further, in Samples 434 and 435 and Sample 111 (see Table 1) in which the Si content was further decreased to not more than 0.30 wt. %, the high-temperature oxidation resistance further improved (evaluation: "excellent"). Then, also in Samples 442 to 445 in which the kind of the second additional element was changed, the high-temperature oxidation resistance was satisfactory (evaluation: "good"). However, in Sample 441 in which the second additional element was not contained, the improvement of the high-temperature oxidation resistance was slight (evaluation: "relatively poor").

According to the results of this evaluation test, it was found that the more the content of the second additional element is decreased, the more the high-temperature oxidation resistance of the electrode material improves, and that if that content is less than 1 wt. %, the high-temperature oxidation resistance becomes satisfactory. Further, it was found that if the content of the second additional element is less than 0.30 wt. %, the high-temperature oxidation resistance further improves. In addition, the electrode material should preferably contain the second additional element, and it was confirmed that, as that second additional element, it suffices to select at least one of Si, Ti, Ca, Sc, Sr, Ba, and Mg.

Example 5

Next, an evaluation test was conducted to confirm the effect exerted by the amount of oxygen dissolved in the electrode material on the progress in oxidation of the electrode material. In fabricating each of Samples 511 and 512 of the electrode materials used in this evaluation test, a raw material was used in which 0.45 wt. % of Y as the first additional element and 0.15 wt. % of Si as the second additional element were added to 99.40 wt. % of Ni, and this raw material was melted and cast by using the vacuum melting furnace to form an ingot in the same way as in Example 1. Subsequently, Samples 511 and 512 of the electrode materials were fabricated by using wires obtained through hot working and wire drawing and having a cross-sectional size of 1.3×2.7 mm. At this time, the amount of dissolved oxygen was adjusted to 45 ppm in Sample 511 and to 30 ppm in Sample 512. In addition, Sample 111 explained with reference to Table 1 had a similar composition, and adjustment was made such that the amount of dissolved oxygen becomes 15 ppm. Then, with respect to the respective Samples 511 and 512, an evaluation was made of the high-temperature oxidation resistance in a test method similar to that of Example 1. The results of this evaluation test are shown in Table 5 below.

TABLE 5

| Sample | Ni Content (wt. %) | 1st Additional Element (wt. %) | 2nd Additional Element (wt. %) | Precipitate | Amount of Dissolved Oxygen (ppm) | σ0.2/σB | High-Temperature Oxidation Resistance |
|---|---|---|---|---|---|---|---|
| 511 | 99.40 | Y 0.45 | Si 0.15 | Ni—Y | 45 | 0.55 | relatively poor |
| 512 | 99.40 | Y 0.45 | Si 0.15 | Ni—Y | 30 | 0.55 | good |
| 111 | 99.40 | Y 0.45 | Si 0.15 | Ni—Y | 15 | 0.55 | excellent |

As shown in Table 5, in Sample 511 in which the amount of dissolved oxygen was set to 45 ppm, the improvement of the high-temperature oxidation resistance was slight (evaluation: "relatively poor"). Meanwhile, in Sample 512 in which the amount of dissolved oxygen was set to 30 ppm, the improvement was satisfactory (evaluation: "good"). On the other hand, the above-described Sample 111 (see Table 1) excelled in the high-temperature oxidation resistance (evaluation: "excellent"). The amount of oxygen dissolved in this Sample 111 was 15 ppm.

According to the results of this evaluation test, it was found that the smaller the amount of oxygen dissolved in the electrode material, the smaller the effect on the progress of oxidation of the electrode material, and it was confirmed that if the amount of dissolved oxygen is not more than 30 ppm, the high-temperature oxidation resistance further improves.

Example 6

Next, an evaluation test was conducted to confirm the effect exerted by the specific resistance of the electrode material on the spark wear resistance of the electrode material. As for each of Samples 611 to 613 of the electrode materials fabricated in conducting this evaluation test, Ni was used as the principal component, and 0.45 wt. % of Y was contained as the first additional element. As the second additional element, Ti was added, and its content was set in sequence to 0.15, 1.00, and 3.00 (wt. %), and the content of Ni which constitutes the balance was adjusted in sequence to 99.40, 98.55, and 96.55 (wt. %). The specific resistance of the respective Samples 611 to 613 thus fabricated was in sequence 10, 15, and 18 (μΩcm).

Then, spark plugs which were completed by assembling ground electrodes fabricated by using the respective Samples 611 to 613 were respectively mounted in an engine for testing (displacement of 2800 cc, 6-cylinder), and a test run for 400 hours (equivalent to 60,000 kilometers at 150 km/h) was conducted. Then, the amount of increase in the size of the spark discharge gap between the center electrode and the ground electrode was confirmed after the test run. At this time, in a case where the amount of increase in the size of the spark discharge gap was not more than 0.2 mm, the spark wear resistance was evaluated as "excellent" since the amount of wear of the electrode material due to the spark discharge was small. In a case where the amount of increase in the size of the spark discharge gap was greater than 0.2 mm and not more than 0.5 mm, the spark wear resistance was evaluated as "good." In addition, in a case where the amount of increase in the size of the spark discharge gap became greater than 0.5 mm, a determination was made that the wear of the electrode material due to the spark discharge was intense, and the spark wear resistance was evaluated as "not good." The results of this evaluation test are shown in Table 6 below.

TABLE 6

| Sample | Ni Content (wt. %) | 1st Additional Element (wt. %) | 2nd Additional Element (wt. %) | Specific Resistance (μΩcm) | Spark Wear Resistance |
|---|---|---|---|---|---|
| 611 | 99.40 | Y 0.45 | Ti 0.15 | 10 | excellent |
| 612 | 98.55 | Y 0.45 | Ti 1.00 | 15 | good |
| 613 | 96.55 | Y 0.45 | Ti 3.00 | 18 | not good |

As shown in Table 6, Sample 611 whose specific resistance was 10 (μΩcm) excelled in the spark wear resistance (evaluation: "excellent"), and Sample 612 whose specific resistance was 15 (μΩcm) showed a satisfactory result in the spark wear resistance (evaluation: "good"). However, in Sample 613 whose specific resistance was 18 (μΩcm), the amount of wear of the electrode material due to the spark discharge was large, and the spark wear resistance was evaluated as "not good."

According to the results of this evaluation test, it was confirmed that if the amount of the second additional element added is decreased and the specific resistance of the electrode material is set to not more than 15 (μΩcm), it is possible to suppress the heat generation of the electrode material itself and control the temperature rise of the electrode material, so that an effect is produced in the spark wear resistance.

Example 7

Next, an evaluation test was conducted to confirm the relationship between the high-temperature oxidation resistance and a ratio (σ0.2/σB) of 0.2% proof stress (σ0.2) to tensile strength (σB). Each of Samples 711 to 714 of the electrode materials fabricated in conducting this evaluation test contained 99.40 wt. % of Ni, 0.45 wt. % of Y as the first additional element, and 0.15 wt. % of Si as the second additional element, and Ni—Y precipitated at least in its grain boundaries as the intermetallic compound. The ratio σ0.2/σB of the respective Samples 711 to 714 was in sequence 0.2, 0.4, 0.6, and 0.7. Then, with respect to the respective Samples 711 to 714, an evaluation was made of the high-temperature oxidation resistance in a test method similar to that of Example 1. The results of this evaluation test are shown in Table 7 below.

TABLE 7

| Sample | Ni Content (wt. %) | 1st Additional Element (wt. %) | 2nd Additional Element (wt. %) | Precipitate | Amount of Dissolved Oxygen (ppm) | σ0.2/σB | High-Temperature Oxidation Resistance |
|---|---|---|---|---|---|---|---|
| 711 | 99.40 | Y 0.45 | Si 0.15 | Ni—Y | 15 | 0.2 | relatively poor |
| 712 | 99.40 | Y 0.45 | Si 0.15 | Ni—Y | 15 | 0.4 | good |
| 713 | 99.40 | Y 0.45 | Si 0.15 | Ni—Y | 15 | 0.6 | good |
| 714 | 99.40 | Y 0.45 | Si 0.15 | Ni—Y | 15 | 0.7 | relatively poor |

As shown in Table 7, in Sample 711 in which σ0.2/σB was 0.2 and in Sample 714 in which it was 0.7, the improvement of the high-temperature oxidation resistance was slight (evaluation: "relatively poor"). However, in Sample 712 in which σ0.2/σB was 0.4 and in Sample 713 in which it was 0.6, the high-temperature oxidation resistance was satisfactory (evaluation: "good").

According to the results of this evaluation test, it was found that if σ0.2/σB is not less than 0.4 and not more than 0.6, the intermetallic compounds are distributed finely and uniformly, so that the coarsening of crystal grains is effectively suppressed over the entirety of the electrode material, and a sufficient effect can be obtained with respect to the high-temperature oxidation resistance.

It goes without saying that various modifications are possible in the present invention. Although in this embodiment the contained elements and contents of the electrode material constituting the center electrode 20 and the ground electrode 30 are defined, this definition may be applied only to the ground electrode 30 which is protruded into the combustion chamber more than the center electrode 20. In addition, although in this embodiment, as intermetallic compounds which are precipitated in the electrode material, compounds of Ni and rare earth elements (particularly Ni—Y and Ni—Nd) have been described by way of example, intermetallic compounds in which not only such two kinds of metal elements but three or more kinds of metal elements are combined may be precipitated.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. A spark plug comprising:

a center electrode; and a ground electrode which is to be exposed in a combustion chamber of an internal combustion engine and which forms a spark discharge gap with the center electrode, wherein at least one of the center electrode and the ground electrode comprises an electrode material whose principal component is Ni and in which an intermetallic compound is precipitated at least intergranularly and intragranularly, the intermetallic compound is a compound comprising at least Ni and a rare earth metal, an amount of oxygen dissolved in the electrode material is not more than 30 ppm, and a ratio of 0.2% proof stress to tensile strength is from 0.4 to 0.6.

2. The spark plug according to claim 1, wherein the intermetallic compound is one of a compound comprising at least Ni and Y and a compound comprising Ni and Nd.

3. The spark plug according to claim 2, wherein the intermetallic compound comprises Ni as a principal component and comprises as a first additional element an element of one of Y and Nd, a content of the first additional element being from 0.3 wt. % to 3 wt. %.

4. The spark plug according to claim 3, wherein the intermetallic compound comprises as a second additional element at least one element selected from the group consisting of Si, Ti, Ca, Sc, Sr, Ba, and Mg.

5. The spark plug according to claim 4, wherein a content of the second additional element in the electrode material is less than 1 wt. %.

6. The spark plug according to claim 5, wherein the second additional element of the electrode material is Si, and a content of the second additional element is less than 0.3 wt. %.

7. The spark plug according to claim 4, wherein, in the electrode material, a content of the first additional element is greater than a content of the second additional element.

8. The spark plug according to claim 7, wherein, in the electrode material, the content of the first additional element is not less than 3 times the content of the second additional element.

9. The spark plug according to claim 4, wherein the electrode material is formed with a raw material in which Ni, the first additional element, and the second additional element are mixed by melting.

10. The spark plug according to claim 1, wherein, in the electrode material, an average grain size of crystal grains after being held for 72 hours at 1000° C. is not more than 300 μm.

11. The spark plug according to claim 1, wherein the electrode material has a specific resistance at normal temperature of not more than 15 μΩcm.

12. The spark plug according to claim 1, wherein the ground electrode comprises the electrode material.

13. An electrode material comprising:

Ni as a main component;

Y or Nd as a first additional element, the contained amount of the first additional element is equal to or larger than 0.3 weight percent and equal to or smaller than 3 weight percent; and dissolved oxygen, the contained amount of the dissolved oxygen is equal to or smaller than 30 ppm, wherein an intermetallic compound containing at least Ni and Y or at least Ni and Nd is precipitated at least in a grain boundary, and a ratio of 0.2% proof stress to tensile strength is from 0.4 to 0.6.

14. The electrode material according to claim 13 further comprising:

at least one of Si, Ti, Ca, Sc, Sr, Ba, and Mg as a second additional element.

15. The electrode material according to claim 14, wherein the contained amount of the second additional element is smaller than 1 weight percent.

16. The electrode material according to claim 15, wherein the second additional element is Si and the contained amount of Si is smaller than 0.3 weight percent.

17. The electrode material according to claim 14, wherein the contained amount of the first additional element is larger than the contained amount of the second additional element.

18. The electrode material according to claim 17, wherein the contained amount of the first additional element is three times larger than the contained amount of the second additional element.

19. The electrode material according to claim 14, wherein Ni, the first additional element, and the second additional element are mixed by melting.

20. The electrode material according to claim 13 having the crystalline grain size smaller than 300 μm after keeping at 1000° C. for 72 hours.

21. The electrode material according to claim 13 having a specific resistance smaller than 15 μΩcm at ambient temperature.

* * * * *